US011505942B2

(12) United States Patent
Line

(10) Patent No.: US 11,505,942 B2
(45) Date of Patent: Nov. 22, 2022

(54) METHOD OF MANUFACTURING OSB WITH EXTRUDED POLYMER BANDS

(71) Applicant: LOUISIANA-PACIFIC CORPORATION, Nashville, TN (US)

(72) Inventor: Jarrod Kevin Line, Brentwood, TN (US)

(73) Assignee: LOUISIANA-PACIFIC CORPORATION, Nashville, TN (US)

( * ) Notice: Subject to any disclaimer, the term of this patent is extended or adjusted under 35 U.S.C. 154(b) by 785 days.

(21) Appl. No.: 16/412,599

(22) Filed: May 15, 2019

(65) Prior Publication Data

US 2020/0002945 A1 Jan. 2, 2020

Related U.S. Application Data

(60) Provisional application No. 62/671,508, filed on May 15, 2018.

(51) Int. Cl.

| | |
|---|---|
| ***E04B 1/84*** | (2006.01) |
| ***E04C 2/24*** | (2006.01) |
| ***B27K 3/08*** | (2006.01) |
| ***E04B 1/86*** | (2006.01) |
| ***E04C 2/12*** | (2006.01) |

(52) U.S. Cl.

CPC ..... *E04C 2/243* (2013.01); *B27K 3/08* (2013.01); *E04B 1/86* (2013.01); *E04C 2/12* (2013.01)

(58) Field of Classification Search

CPC ..... B27K 3/08; E04B 1/86; E04B 5/12; E04B 2103/04; E04C 2/12; E04C 2/243; E04C 2/16; Y10T 29/49947; E04F 13/16; E04F 21/18; E04G 21/1891; E04D 15/025

USPC ..... 52/741.1, 105; 181/293, 294, 295

See application file for complete search history.

(56) References Cited

U.S. PATENT DOCUMENTS

| | | | | |
|---|---|---|---|---|
| 4,061,819 | A | 12/1977 | Barnes | |
| 5,924,252 | A | 7/1999 | Deike | |
| 6,539,643 | B1 * | 4/2003 | Gleeson | E04C 2/043 33/563 |
| 6,804,923 | B1 * | 10/2004 | Potter | E04B 5/04 52/480 |
| 6,880,299 | B2 * | 4/2005 | Martin | E04C 2/043 52/745.19 |

(Continued)

FOREIGN PATENT DOCUMENTS

| | | | |
|---|---|---|---|
| EP | 0368135 | A1 | 5/1990 |
| WO | WO9733051 | A1 | 9/1997 |

OTHER PUBLICATIONS

International Search Report and Written Opinion, PCT/US2019/032359, Louisiana-Pacific Corporation (international filing date May 15, 2019).

*Primary Examiner* — Chi Q Nguyen

(74) *Attorney, Agent, or Firm* — Wayne Edward Ramage; Baker Donelson

(57) ABSTRACT

A system for introducing a noise-dampening polymer in-line in the manufacturing process of a manufactured wood product to achieve higher acoustic performance in siding, sheathing, roofing, flooring, and similar applications using the manufactured wood product. Several lines or bands of the noise-dampening polymer are deposited transversely across one side or face of the product. The polymer is deposited where the product is expected to contact joists or studs. The polymer may be a viscoelastic polymer.

11 Claims, 3 Drawing Sheets

(56) References Cited

U.S. PATENT DOCUMENTS

| | | | | |
|---|---|---|---|---|
| 9,163,397 | B2 * | 10/2015 | Willson | E04C 2/043 |
| 2006/0288175 | A1 * | 12/2006 | Seto | G06F 13/4239 711/105 |
| 2007/0157994 | A1 | 7/2007 | Scoville et al. | |
| 2009/0139157 | A1 * | 6/2009 | Jones | E04H 3/14 52/145 |
| 2011/0168484 | A1 * | 7/2011 | Lenz | E04B 1/86 181/288 |
| 2014/0053474 | A1 * | 2/2014 | Schuman | E04F 13/16 52/105 |
| 2014/0053484 | A1 * | 2/2014 | Hansson | B32B 7/04 52/309.1 |
| 2015/0314564 | A1 * | 11/2015 | Mancini | B32B 21/02 156/60 |
| 2015/0322668 | A1 * | 11/2015 | Quinn | E02D 27/00 52/236.9 |
| 2020/0338867 | A1 * | 10/2020 | Luttwak | B32B 9/047 |
| 2021/0285230 | A1 * | 9/2021 | Baert | E04F 13/147 |

* cited by examiner

METHOD OF MANUFACTURING OSB WITH EXTRUDED POLYMER BANDS

This application claims benefit of and priority to U.S. Provisional App. No. 62/671,508, filed May 15, 2018, which is incorporated herein by specific reference in its entirety for all purposes.

FIELD OF INVENTION

This invention relates to a method and system for manufacturing wood products (such as OSB, oriented strand board) with acoustic dampening polymer bands.

BACKGROUND OF THE INVENTION

Acoustic comfort is important in building design. Noise is the often the primary complaint by home owners in residential single-family homes, and noise reduction also is an important performance criterion in multi-family and commercial construction (particularly in the healthcare and education segments). Airborne noise/STC (Sound Transmission Class) rating and impact noise (Impact Insulation Class, IIC) rating in wall and floor or ceiling assemblies often is specified in codes and standards by ANSI, IgCC and LEED.

Airborne noise from outside or inside the living space has been addressed with various field-applied and pre-fabricated noise dampening constructions products, such as resilient channels, clips, staggered studs, multiple layers of drywall, wall cavity insulation, and laminated acoustic drywall. In flooring, wall, and ceiling structures, "resilient channels" are often used (and are required in some types of constructions), which reduce the transmission of airborne sound by placing or suspending a material from a stud or joint.

However, there are no building materials, such as OSB-based siding, sheathing, roofing or flooring, that apply a sound dampening material in the primary manufacturing process of panels with improved acoustic performance.

DETAILED DESCRIPTION OF EXEMPLARY EMBODIMENTS

In various exemplary embodiments, the present invention comprises a method or process for manufacturing wood products with acoustic dampening properties. The manufactured wood products include, but are not limited to, oriented strand board (OSB), laminated strand lumber (LSL), medium-density fiberboard (MDF), particleboard, or various similar wood composites.

In several embodiments, the present invention comprises a system for introducing a noise-dampening polymer in-line in the manufacturing process of a manufactured wood product to achieve higher acoustic performance (e.g., Sound Transmission Class-STC and/or Impact Insulation Class-IIC rating) in siding, sheathing, roofing, flooring, and similar applications using the manufactured wood product. The polymer may be a viscoelastic polymer.

Several lines or bands of the noise-dampening polymer are deposited transversely across one side or face of the product (e.g., OSB panel). The polymer is deposited where the product is expected to contact joists or studs. Accordingly, in several embodiments the polymer lines or bands are applied on the side/face of the product opposite nail lines, which typically are indicated or marked on the outward or upward facing side of the panel.

Figure 1:
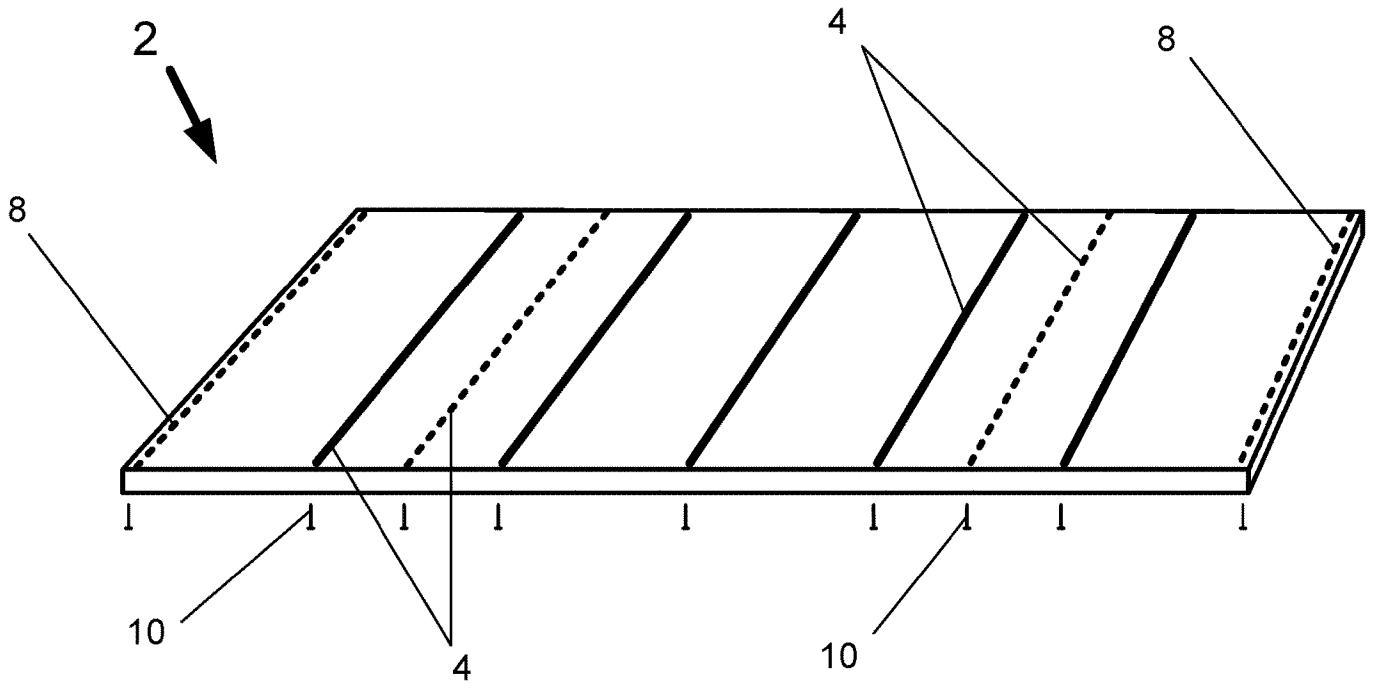
FIG. 1 shows a view of an OSB panel with lines or bands of sound-dampening polymer in accordance with an embodiment of the present invention.
Figure 2:
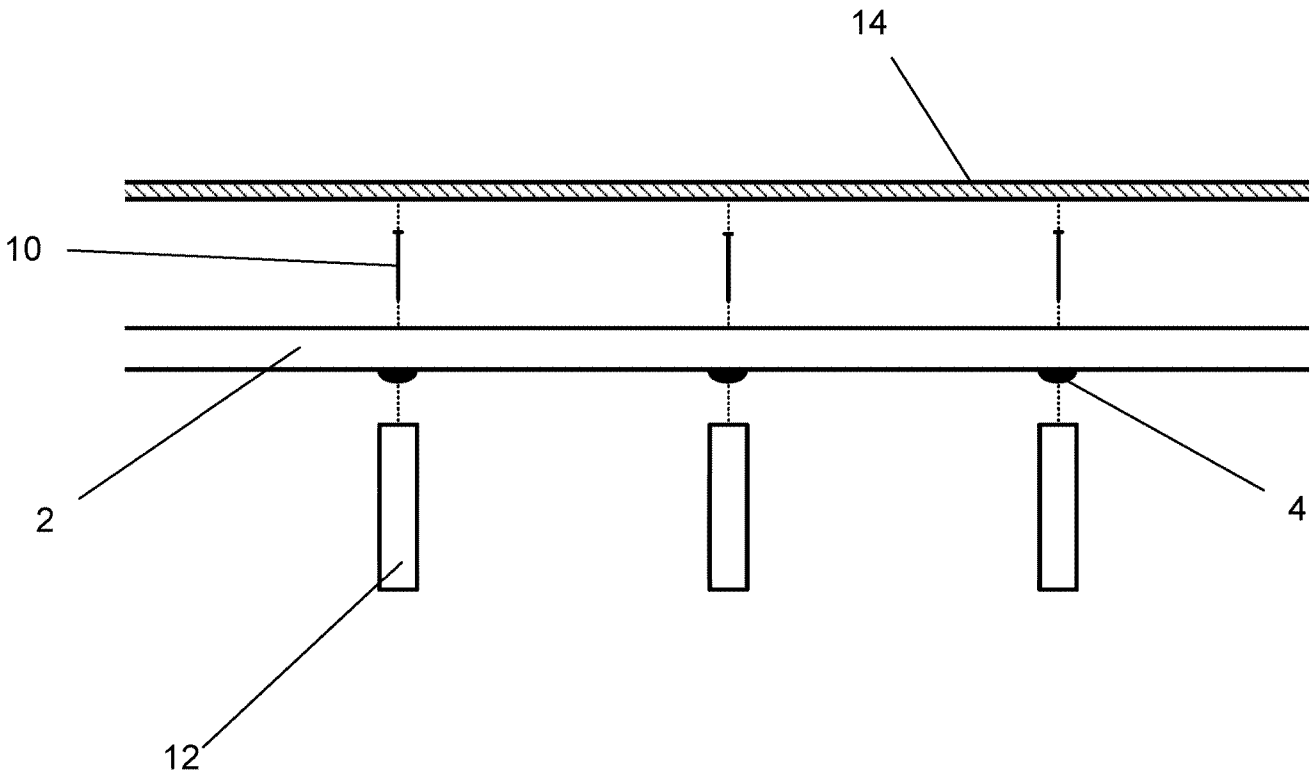
FIG. 2 shows a cutaway view of the OSB panel of FIG. 1 being installed as a flooring panel.

FIG. 1 shows an example of a bottom face of an OSB panel 2 with lines of sound dampening polymer 4 applied at multiples of 16 inches, 24 inches, and 48 inches from an edge (parallel to the polymer lines), as well as along each corresponding edge 8 of the panel. This arrangement is beneficial as the edges of the OSB panel are typically lined up with underlying floor joists during construction, with intervening joists typically spaced every 16, 24 or 48 inches. When installed, the corresponding sound dampening polymer lines rest on top of the joists, acting as a sound dampening barrier between the panel and the joists (i.e., the polymer application along the face opposite the nail lines provides dampening material in the areas of the interface with the floor joists, as nails 10 are applied during construction to secure the OSB panel 4 to the joists 12, as seen in FIG. 2). An overlay 16, such as carpet, tile or other floor covering known in the art, may then be added over the installed OSB panel subflooring.

When multiple polymer lines are applied at variable spacing, as seen in FIG. 1, only the polymer lines that correspond to particular joist spacing will be in contact with a joist or joists. The remaining lines essentially are unused, although they may provide some benefit if in contact with cross-joints or end members. In alternative embodiments, a product may be produced with polymer lines at set spacing intervals, so that a user would select the product with appropriately-spaced lines for use based on the joist spacing.

The polymer may be heat cured or hot melt (i.e., thermoplastic). In one embodiment, the polymer is applied post-press on the main manufacturing line, or through a post-application process off-line. The lines or bands can be continuous, or intermittent (i.e., dots or streaks) (examples of both types of lines are shown in FIG. 1), and may be applied with overhead linear applications or sprayers. In some additional embodiments, additional polymer may be added in-between the standard spaced lines (as described above). The additional polymer may help in providing a sound barrier in cases where joists are not straight or are misaligned.

Figure 3:
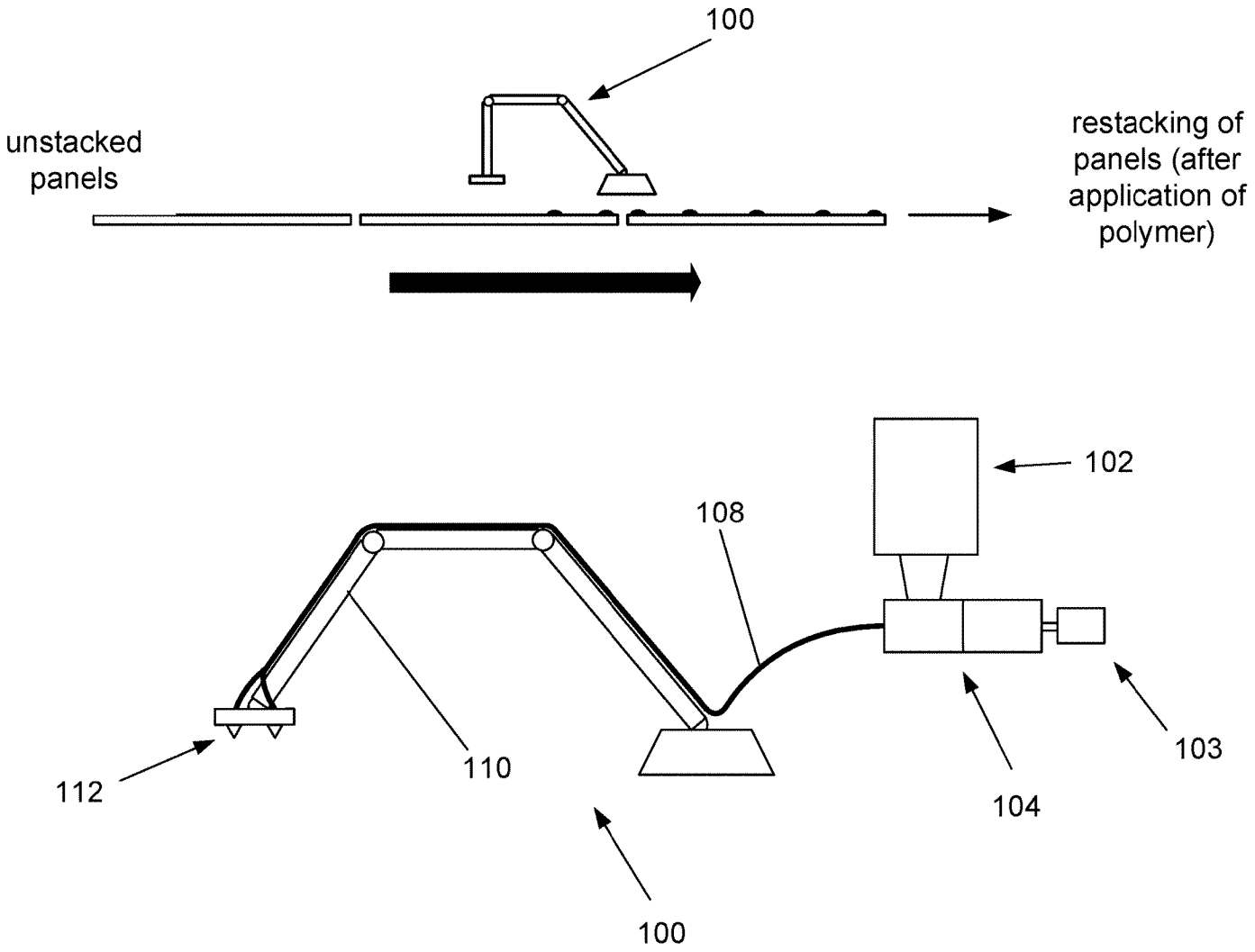
FIG. 3 shows an embodiment of a robotic polymer or plastic extruder device.

FIG. 3 shows a multi-axis robotic device 100 suitable for in-line use for application of the polymer to unstacked panels. Low cost injection molded plastics (e.g., HDPE, LDPE, PP, and so on) are fed in bead or spherical form from a bead hopper 102 into a heating element in an injection molding mechanism 104, and then extruded by means of a motor-driven 103 screw. The liquefied plastic travels through a heat-traced, heat-jacketed, flexible, high-pressure tube(s) or line(s) 108 disposed on a multi-axis robotic arm 110 to an extruder nozzle or nozzles 112 at the end of the arm system. The extruder nozzles can range in size from 1 mm to 20 mm (e.g., orifice size), and can apply a variety of thickness, widths and patterns to the panel. It should be noted that while this device can be used to apply the bands or lines as described above, it also be used to more flexibly apply polymer features to wood or other panel products or substrates (e.g., ventilated siding, acoustic OSB, and the like) for a variety of purposes.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A method of producing a wood product with acoustic dampening properties, comprising the steps of:

applying a noise-dampening polymer to a plurality of locations on a back face of a manufactured wood product;

wherein the plurality of locations comprise a plurality of linear areas parallel to each other and a first edge of the manufactured wood product; and further wherein the plurality of linear areas are spaced at a series of pre-determined distances from the first edge and each other, said spacing selected to correspond to an end-use application with a corresponding spacing of joists, studs, or other flooring or framing support elements.

2. The method of claim 1, wherein the plurality of linear areas comprise an area proximate the first edge, and an area proximate a second edge, wherein the second edge is opposite and parallel to the first edge.

3. The method of claim 1, wherein the plurality of locations further comprise locations between the plurality of linear areas.

4. The method of claim 1, wherein the polymer is applied in a continuous line in each linear area.

5. The method of claim 1, wherein the polymer is applied intermittently in each linear area.

6. The method of claim 1, wherein the plurality of linear areas are spaced at multiples of 16 inches, 24 inches, or 48 inches from the first edge.

7. The method of claim 1, wherein the plurality of linear areas are spaced at multiples of 16 inches or 24 inches from the first edge.

8. The method of claim 1, wherein the plurality of linear areas are directly opposite a plurality of nail lines indicated on a front face of the product.

9. The method of claim 1, wherein the polymer comprises a viscoelastic polymer.

10. The method of claim 1, wherein the polymer is heat cured or hot melt.

11. The method of claim 1, wherein the step of applying polymer is post-press on a manufacturing line.

* * * * *